US009777506B2

(12) United States Patent
LaHood

(10) Patent No.: US 9,777,506 B2
(45) **Date of Patent: *Oct. 3, 2017**

(54) PORTABLE SHELTERS HAVING A HINGED SIDE WALL

(71) Applicant: CLAM CORPORATION, Rogers, MN (US)

(72) Inventor: John Matthew LaHood, Waconia, MN (US)

(73) Assignee: Clam Corporation, Rogers, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/463,528

(22) Filed: Mar. 20, 2017

(65) Prior Publication Data

US 2017/0234028 A1 Aug. 17, 2017

Related U.S. Application Data

(63) Continuation of application No. 15/042,819, filed on Feb. 12, 2016, now Pat. No. 9,598,876.

(51) Int. Cl.

| | |
|---|---|
| ***E04H 15/48*** | (2006.01) |
| ***E04H 15/58*** | (2006.01) |
| *E04H 15/00* | (2006.01) |

(52) U.S. Cl.

CPC ..... *E04H 15/48* (2013.01); *E04H 15/58* (2013.01); *E04H 15/001* (2013.01)

(58) Field of Classification Search

CPC ..... E04H 15/48; E04H 15/001; E04H 15/58; E04H 15/042; E04H 15/819

USPC ..... 135/143

See application file for complete search history.

(56) References Cited

U.S. PATENT DOCUMENTS

| | | | | |
|---|---|---|---|---|
| 1,728,356 | A | | 9/1929 | Morgan |
| 3,368,575 | A | | 2/1968 | Besonen |
| 3,550,601 | A | | 12/1970 | Peters |
| 3,709,237 | A | | 1/1973 | Smith |
| 3,810,482 | A | | 5/1974 | Beavers |
| 3,847,170 | A | | 11/1974 | Anderson |
| 3,941,140 | A | | 3/1976 | Beavers |
| 4,026,312 | A | | 5/1977 | Beavers |
| 4,067,346 | A | | 1/1978 | Husted |
| 4,077,417 | A | | 3/1978 | Beavers |
| 4,632,138 | A | | 12/1986 | Irwin |
| 4,819,680 | A | | 4/1989 | Beavers |
| 4,941,499 | A | | 7/1990 | Pelsue et al. |
| 5,382,111 | A | | 1/1995 | Melashenko et al. |
| 5,573,028 | A | * | 11/1996 | van der Stigohel .... E04H 15/48 135/119 |
| 5,592,961 | A | | 1/1997 | Chin |

(Continued)

*Primary Examiner* — David R Dunn
*Assistant Examiner* — Danielle Jackson
(74) *Attorney, Agent, or Firm* — Cook Alex Ltd.

(57) ABSTRACT

A portable shelter having a hinged side wall includes an enclosure having a plurality of interconnected side walls defining a floor space and being connected to a top wall. At least one of the side walls is a hinged side wall that is pivotally connected to the enclosure and includes opposed first and second side edges and a tope edge that defines an opening in the enclosure. At least one connecting member on the enclosure is configured to selectively connect and disconnect at least the first side edge and the top edge of the hinged side all at the opening. The disclosure also provides a method of hinging the side wall of the portable shelter to an open position.

16 Claims, 4 Drawing Sheets

(56) References Cited

U.S. PATENT DOCUMENTS

| | | | |
|---|---|---|---|
| 5,628,338 | A | 5/1997 | Stumbo |
| 5,820,189 | A | 10/1998 | Tew |
| 5,906,217 | A | 5/1999 | Hill |
| 6,098,335 | A | 8/2000 | Brown, Jr. |
| 6,360,761 | B1 | 3/2002 | Zheng |
| 6,701,948 | B2 | 3/2004 | Jopp et al. |
| 6,782,905 | B2 | 8/2004 | Chu et al. |
| 7,040,335 | B1 | 5/2006 | Ransom |
| 7,614,415 | B1 | 11/2009 | Wehner |
| 7,743,781 | B2 | 6/2010 | Slaughter |
| 7,958,904 | B2 | 6/2011 | Lau |
| 8,915,258 | B1 | 12/2014 | Beam et al. |
| 9,085,914 | B1 | 7/2015 | Kulm |
| 9,163,425 | B1 | 10/2015 | Kubica et al. |
| 9,238,924 | B2 | 1/2016 | Wyant |
| 2005/0100400 | A1 | 5/2005 | Fulcher et al. |
| 2006/0060235 | A1 | 3/2006 | Ball |
| 2008/0083443 | A1 | 4/2008 | Eastman, II |
| 2008/0210283 | A1 | 9/2008 | Hinz et al. |
| 2009/0084420 | A1 | 4/2009 | Pelsue |
| 2010/0200038 | A1 | 8/2010 | Roman et al. |
| 2011/0168221 | A1 | 7/2011 | Schlipf |
| 2013/0074894 | A1 | 3/2013 | Cook |
| 2013/0306121 | A1 | 11/2013 | Hung Lau |

* cited by examiner

PORTABLE SHELTERS HAVING A HINGED SIDE WALL

CROSS-REFERENCE TO RELATED APPLICATION

This application is a continuation of and claims the benefit of U.S. patent application Ser. No. 15/042,819, filed Feb. 12, 2016, the disclosure of which is hereby incorporated by reference in its entirety.

BACKGROUND OF THE INVENTION

Field of the Invention

The present invention generally relates to portable shelters, and more particularly to portable enclosures and methods that permit hinging of a side wall to achieve selective improved access to the interior of the enclosures.

Discussion of the Prior Art

Portable shelters, such as may be used for ice fishing, are known and typically include a lightweight flexible enclosure supported by a collapsible frame. The flexible enclosure often has multiple side walls, with each side wall permanently connected to adjacent side walls and to a top wall. When the collapsible frame is erected, the enclosure is free standing. Such portable shelters generally are sized to accommodate a limited number of individuals, their gear and/or some furnishings. All of the occupants and the contents typically must enter and exit the enclosure through a modest-sized doorway opening that is spaced above a ground surface, and generally includes only a portion of a side wall that is just large enough for a person to step through. The doorway opening commonly may be closed by a door.

SUMMARY OF THE INVENTION

The purpose and advantages of the invention will be set forth in and apparent from the description and drawings that follow, as well as will be learned by practice of the claimed subject matter.

This disclosure generally provides portable shelters that retain the qualities of compactness, light weight and easy set-up of portable shelters, yet have desirable advantages. The portable shelters feature an enclosure having a side wall that selectively may be hinged to provide enhanced, quick and open access for ease in moving items into or out of the enclosure, and/or to expand the uses of the enclosure. The hinged side wall also can be held in an open position, such as by staking to a ground surface, to serve as a wind break, if desired.

The portable shelters feature the ability to disconnect a side wall along one side edge and a top edge. This permits a user to quickly and conveniently partially disconnect and hinge open and reclose the side wall, without requiring the use of tools. The selective hinged displacement of a side wall advantageously provides an enlarged opening for passage of occupants and larger items, while maintaining an essentially unobstructed ground surface at the enlarged opening. The enhanced access to the interior space of the enclosure also may transform the shelter so as to have additional uses. For instance, a shelter having a relatively large enclosure and having a hinged side wall at an end of the enclosure may be capable of permitting entry and sheltered storage of relatively large equipment, such as a snow mobile, sled or other gear. The open floor space and absence of the usual obstruction of a partial side wall and ground skirt at the opening also facilitate more flexible loading and unloading of furnishings and other items, as well as accommodation of larger items that previously could not be moved into or out of a conventional portable shelter having a common doorway opening and door in the form of a fabric flap.

In a first aspect, this disclosure provides a portable shelter having a hinged side wall, including an enclosure that includes a plurality of interconnected side walls defining a floor space and being connected to a top wall, with at least one of the side walls further comprising a hinged side all that is pivotally connected to the enclosure and includes opposed first and second side edges and a top edge that define an opening in the enclosure, and with at least one connecting member on the enclosure and being configured to selectively connect and disconnect at least the first side edge and the top edge of the hinged side wall at the opening.

In a further aspect, this disclosure provides a method of hinging a side wall of a portable shelter to an open position that includes the steps of providing an enclosure having a plurality of interconnected side walls defining a floor space and being connected to a top wall, with at least one of the side walls further comprising a hinged side wall that is pivotally connected to the enclosure, wherein the hinged side wall includes opposed first and second side edges and a top edge and defines an opening in the enclosure, and further comprising at least one connecting member on the enclosure and being configured to selectively connect and disconnect at least the first side edge and the top edge of the hinged side wall at the opening. The method further includes the steps of disconnecting the connecting member along the first side edge and the top edge of the hinged side wall, and pivoting the hinged side wall to an open position.

As above noted, the example portable shelters having a hinged side wall and example methods of hinging a side wall of a portable shelter to an open position of this disclosure provide several advantageous features. The example shelters and methods provide the ability to quickly and conveniently hinge a side wall of an enclosure. This is accomplished by being able to readily disconnect a connecting member of a side wall along a first side edge and a top edge, thereby defining an opening in the enclosure. The hinged side wall then may be conveniently moved to a hinged open position to gain enhanced access to the interior of the resulting enclosure. The hinged open side wall provides the benefit of entry and exit to the interior over a floor space that is open and essentially unobstructed. Thus, occupants need not step or crawl through a raised relatively small doorway opening to enter or exit the enclosure. Rather, the open floor space at the entry of the present portable shelters permit advantageous flexibility as to the size of the furnishings and gear that may enter the enclosure, and they need not be lifted to enter or exit the enclosure. The examples also offer the ability to accomplish these advantages with the further convenience of the enclosures having a pop up structure. This allows enclosures with a hinged side wall to be swiftly erected and/or collapsed, without the use of tools.

It is to be understood that both the foregoing general description and the following detailed description are exemplary and provided for purposes of explanation only, and are not restrictive of the subject matter claimed. Further features and objects of the present disclosure will become more fully apparent in the following description of the preferred embodiments and from the appended claims.

BRIEF DESCRIPTION OF THE DRAWINGS

In describing the preferred embodiments, reference is made to the accompanying drawing figures wherein like parts have like reference numerals, and wherein.

Figure 1:
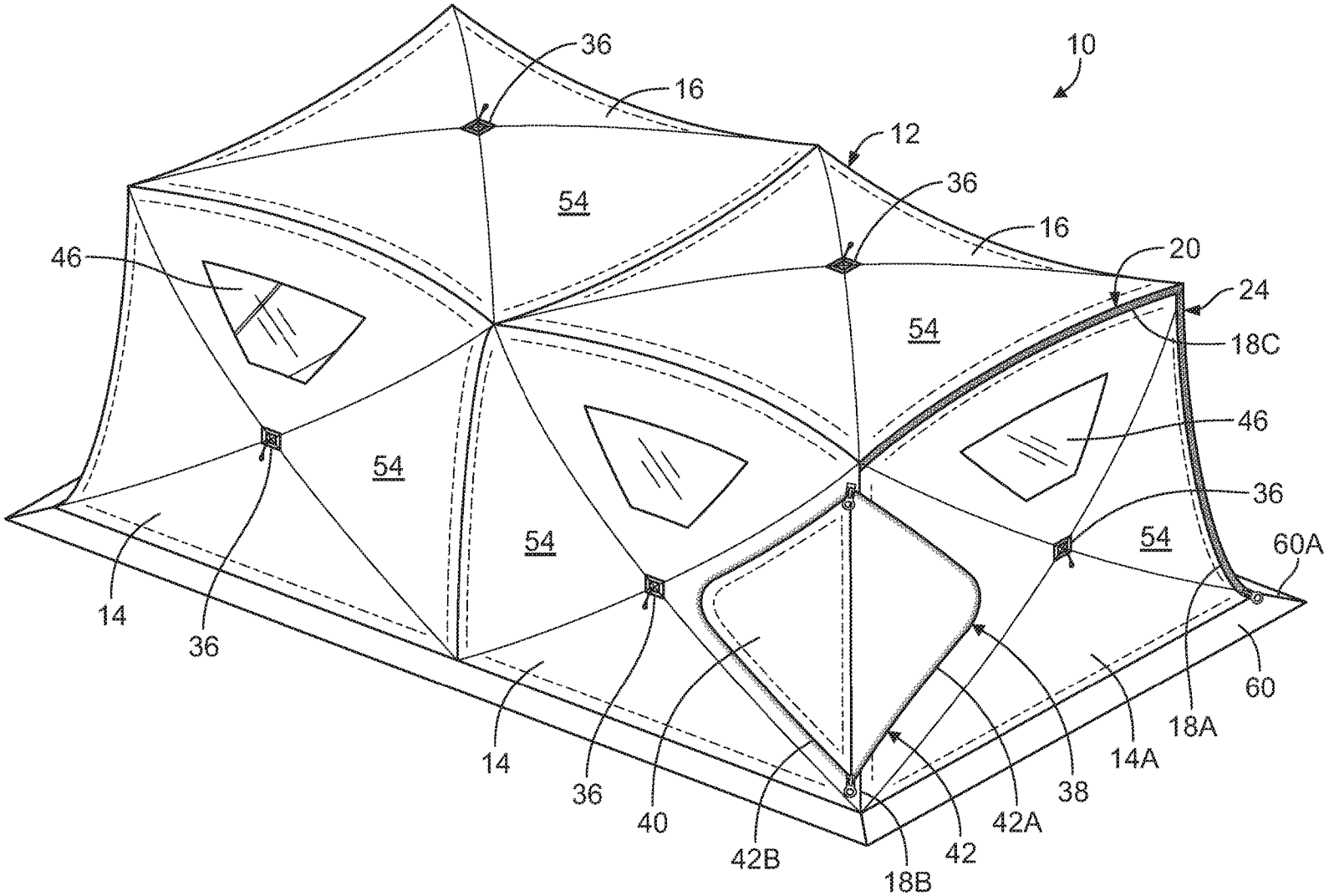
FIG. 1 is a perspective view of an example portable shelter having a hinged side wall of the present disclosure.

It should be understood that the drawings are not to scale. While some mechanical details of example portable shelters, including other plan and section views of the examples shown and of examples that may have alternative configurations, have not been included, such details are considered well within the comprehension of those of skill in the art in light of the present disclosure. It also should be understood that the present invention is not limited to the example embodiments illustrated.

DETAILED DESCRIPTION OF THE PREFERRED EMBODIMENTS

For the following defined terms, these definitions shall be applied, unless a different definition is given in the claims or elsewhere in this disclosure. As used in this disclosure and the appended claims, the singular forms "a", "an", and "the" include plural referents unless the content clearly dictates otherwise. As used in this disclosure and the appended claims, the term "or" is generally employed in its sense including "and/or" unless the content clearly dictates otherwise.

Referring generally to FIGS. 1-4, it will be appreciated that portable shelters having a hinged side wall of the present disclosure generally may be embodied within numerous configurations, and may be used in various ways to alter and enhance the convenience of users. Indeed, while acknowledging that all of the example configurations of portable shelters having a hinged side wall need not be shown herein, examples are provided to better demonstrate that a variety of configurations and methods of use are contemplated.

Turning to an example embodiment of a portable shelter having a hinged side wall shown in FIGS. 1-4, a portable shelter 10 is shown and generally comprises a portable enclosure 12 that includes a plurality of interconnected side walls 14, 14A defining a floor space and being connected to a top wall 16, with at least one of the side walls 14A further comprising a hinged sidewall that is pivotally connected to the enclosure 12. The hinged side wall 14A includes opposed first and second side edges 18A, 18B and a top edge 18C that define an opening 20 in the enclosure 12. The opening 20 in the enclosure has a perimeter edge 22, having first and second side edges 22A, 22B and a top edge 22C. The portable shelter 10 further includes at least one connecting member 24 on the enclosure 12 that is configured to selectively connect and disconnect at least the first side edge 18A and the top edge 18C of the hinged side wall 14A at the opening 20. Thus, the hinged side wall 14A may be hinged to an open position relative to the enclosure 12 by disconnecting the hinged side wall 14A from the perimeter edge 22 of the opening 20 along the first side edge 18A and the top edge 18C of the hinged side wall 14A. In this example, the perimeter edge 22 of the opening 20 is shown to be located at the corners from the hinged side wall 14A to the adjacent side walls 14 and to the top wall 16. It will be appreciated that the perimeter edge 22 of the opening 20 could be spaced from the actual corners, but it is desirable to be disconnected at the perimeter of the opening 20 to avoid having an obstruction that would limit the freedom of movement through the opening 20.

In this example portable shelter 10, the at least one connecting member 24 includes complementary opposed first and second connectors located along at least a portion of the first side edge 18A and the top edge 18C of the hinged side wall 14A and along the opening 20 in the enclosure 12. The at least one connecting member 24 may extend continuously along the first side edge 18A and the top edge 18C of the hinged side wall, or along just a portion of one or the other edge. The example connecting member 24 that is shown in FIGS. 1-4 includes two complementary portions, with a first portion 24A attached to the hinged side wall 14A along the first side edge 18A and the top edge 18C, and a second portion 24B attached at the edge 22 of the opening 20 of the enclosure 12. The first portion 24A of the connecting member 24 is configured to be connected to the second portion 24B of the connecting member 24. While it may be of a different construction, such as incorporating snaps, hook and loop fasteners or the like, the example connecting member 24 that is shown includes complementary portions of a detachable zipper assembly.

Figure 2:
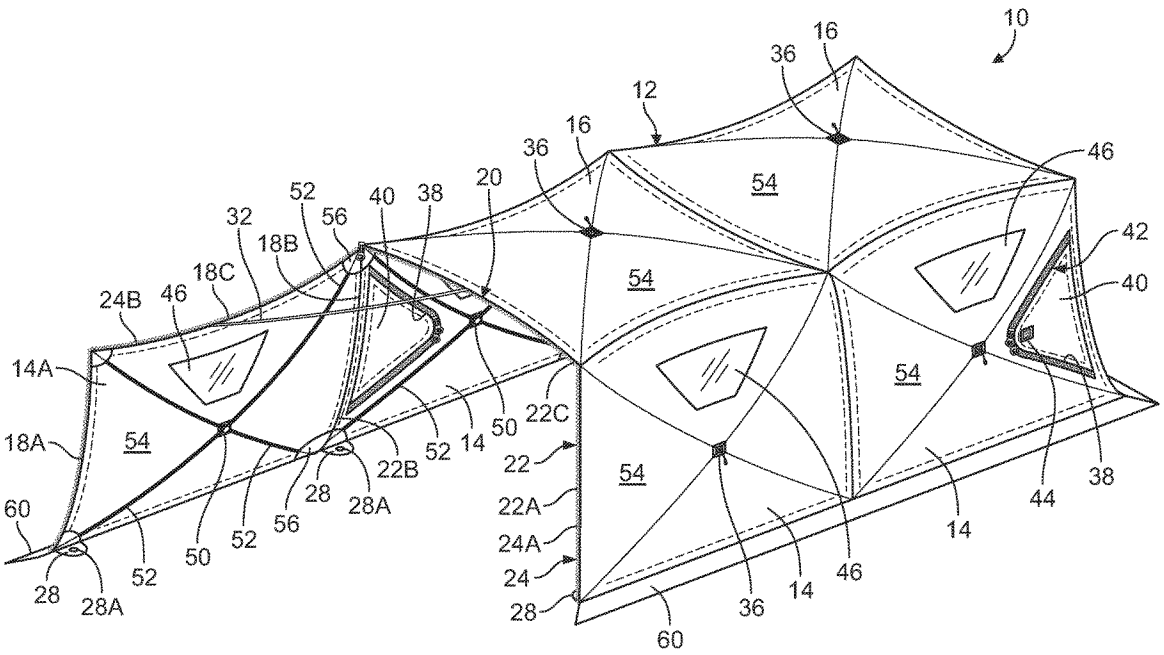
FIG. 2 is a perspective view of the example portable shelter having a hinged side wall of FIG. 1, showing the hinged side wall in an open position that is parallel to an adjacent side wall, and showing the interior side of the hinged side wall.
Figure 3:
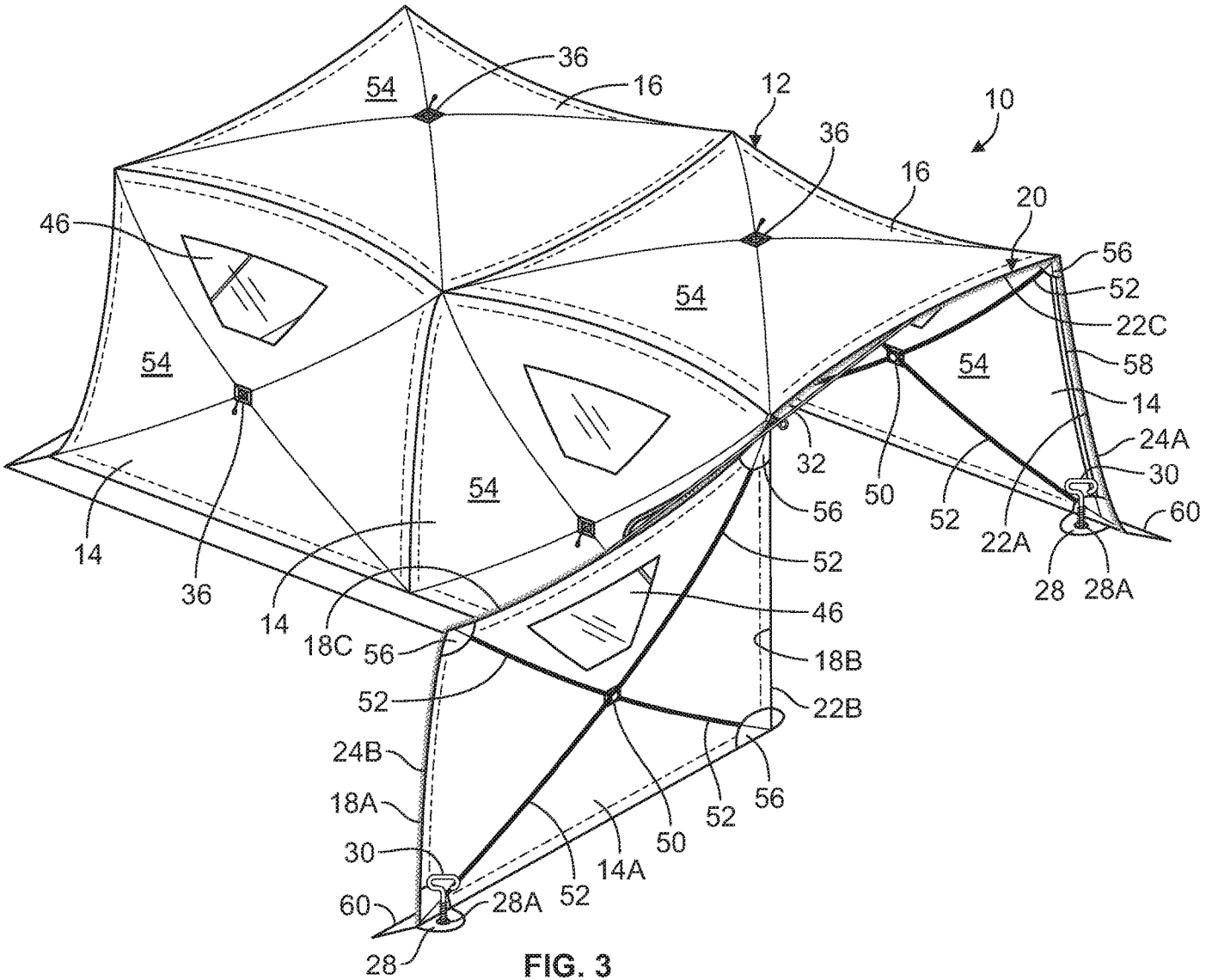
FIG. 3 is a perspective view of the example portable shelter having a hinged side wall of FIG. 1, showing the hinged side wall in an open position that is perpendicular to an adjacent side wall, and showing the interior side of the hinged side wall is a perspective view of the example convertible shelter system of FIG. 2, showing the exterior side of the hinged side wall.

It will be appreciated that the side walls 14 and hinged side wall 14A may further include internal anchor straps 28 configured for use in holding a side wall 14 in place, or for holding the hinged side wall 14A in a hinged, open position, as shown in FIG. 3. Such internal anchor straps 28 may include a tab of flexible material or fabric having an eyelet 28A through which an anchor 30 may pass downward and into the ground surface. The interior anchor straps 28 may be used adjacent the opening 20 to help anchor the enclosure to the ground surface and to keep the side walls 14 from moving further apart at the ground surface. In an example of use for ice fishing, the anchor 30 may be a threaded spike having a handle, for ease of turning by hand to secure the side walls 14 and/or to secure the hinged side wall 14A in a selected hinged open position. This arrangement permits the hinged side wall 14A to provide added utility by serving as a wind break, such as when it may be desirable if a user seeks to sit or fish outside of the enclosure, but to be at least partially sheltered from the wind. A hinging limiter 32, such as is shown for example in FIGS. 2-4, in the form of a removable elongated strap, also may be provided to limit the angle to which the hinged side wall 14A may swing to an open position. It will be appreciated that the hinging limiter 32 may be of various alternative constructions and may include a construction that is adjustable in length, such as may be provided by a buckle on the example strap.

Figure 4:
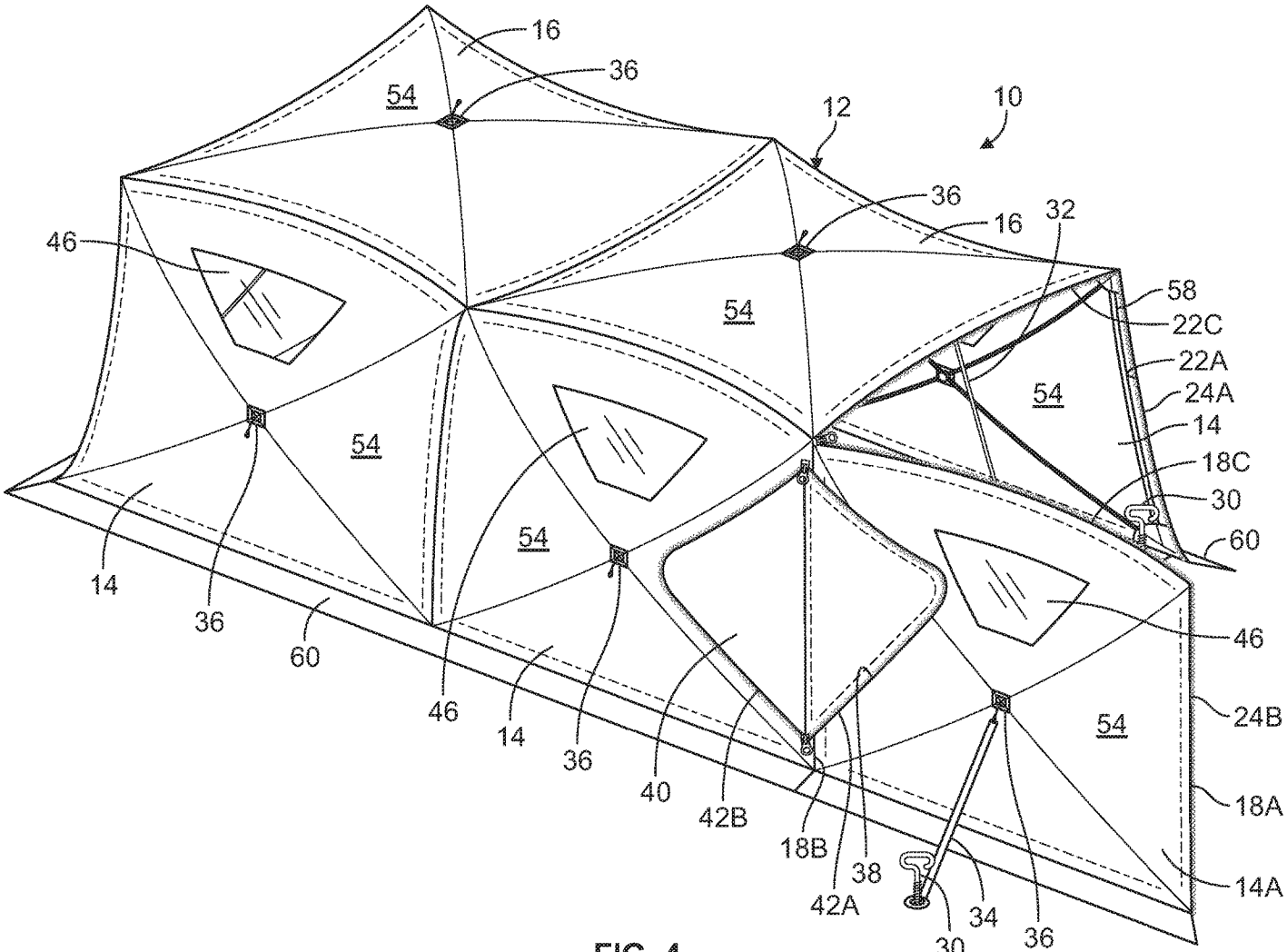
FIG. 4 is a perspective view of the example portable shelter having a hinged side wall of FIG. 1, showing the hinged side wall in an open position that is parallel to an adjacent side wall, and showing the exterior side of the hinged side wall.

In addition, the hinged side wall 14A may be steadied and anchored in a hinged open position by an optional external anchor strap 34. Each of the side walls 14, 14A and top wall 16 may be equipped with an external connector 36, which are shown in FIGS. 1-4 at the center of each wall. As shown in FIG. 4, a first end of an external anchor strap 34 may be connected to an external connector 36 at the center of the hinged side wall 14A and a second end of the external anchor strap 34 may be staked to the ground using a suitable anchor, such as the anchor 30 previously described, which may extend through and end of the external anchor strap 34.

As shown in FIGS. 1, 2 and 4, at least one of the side walls 14, 14A of the enclosure may include a doorway 38. In this example, the doorway 38 may be closed by a door 40 that is in the form of a flap of material or fabric of a side wall 14, or may include alternative materials that differ from the material of the side walls 14. In this example, the doorway 38 and door 40 are shown as having a connecting member 42 having complementary portions 42A and 42B of a zipper located at their edges to be able to provide a convenient and relatively weather proof closure. It will be appreciated that one or more zippers, or alternative mechanical connecting members, such as hook and loop fasteners, snaps or the like, also could be used to close a door in a side wall 14, 14A. Also, fasteners 44 may be used for holding open a door 40. The fasteners 44 may be of any suitable type, such as hook and loop, snaps or other alternatives. Thus, a first fastener portion may be located on the exterior of a door 40, while a second fastener portion may be located on an opposed exterior of a side wall 14, 14A, for removable connection when the door 40 is in a fully opened position.

FIGS. 1-4 also show at least one of the side walls 14, 14A may include a window 46. The window 46 may include a transparent panel and/or a screen that is permanently connected to a side wall 14, 14A in a closed position, or may be configured to permit opening. It will be appreciated that additional windows of generally similar construction may be connected to the top wall 16, such as to form a skylight, or that windows may have an alternative construction, such as may be provided by a flap that may be held in an open or closed position.

The example enclosure 12 further comprises a pop up structure that supports the side walls and top wall. In the example shown, each side wall 14, 14A and the top wall 16 have at least one hub 50 that is connected to a plurality of rods 52. The plurality of rods 52 are connected to a fabric panel 54 of the respective side wall or top wall, such as by fitting within a pocket in the corner of the respective panel. This example is shown with two fabric panels 54 along elongated sides and the top of the enclosure 12, and a single fabric panel 54 at each end of the enclosure 12. It will be appreciated that other sizes and combinations of fabric panels may be used to provide larger or smaller enclosures, and that the term "fabric" panels may include construction that use materials that are not traditionally thought of as a fabric, such as plastic sheets or other materials, as desired. For each of the fabric panels 54 of the side walls 14, 14A and the top walls 16, the plurality of rods 52 include four rods 52 that are pivotally connected to the hub 50 and are movable to achieve an erected position that places the fabric panel 54 in tension, such as by pivoting to an over-center position.

As seen in FIGS. 3 and 4, an optional additional rod 58 may be used along the side of the opening 20 in the enclosure 12, if there is a desire for additional vertical support of a side wall 14 at the opening 20. The rods 52 and 54 may be somewhat flexible and may be constructed of suitable materials, such as fiberglass, plastic or metal. It also will be appreciated that alternative collapsible frame structures may be utilized.

The portable shelter 10 also is shown with a skirt 60 around the base of the exterior of the enclosures 12. It will be appreciated that there is a gap 60A in the skirt 60 at the base of the first side edge 18A that is disconnected when the hinged side wall 14A is to be hinged relative to the enclosure 12. This ensures that the floor area, defined by the connected side walls 14, 14A of the enclosure 12 will not have an obstruction at the opening 20 when the hinged side wall 14A is in an open position. Thus, when the hinged side wall 14A is moved to a hinged open position, the opening in the enclosure will define an open floor space that will permit convenient entry along a continuous open floor for large items that may stay on the ground surface, such as a snow mobile, sled or furnishings.

In light of the aforementioned description of the example portable shelters 10, it will be appreciated that one may follow a method of hinging a side wall of a portable shelter to an open position that is consistent with this disclosure. The method includes the steps of providing an enclosure 12 having a plurality of interconnected side walls 14, 14A defining a floor space and being connected to a top wall 16, with at least one of the side walls being a hinged side wall 14A that is pivotally connected to the enclosure 12, wherein the hinged side wall 14A includes opposed first and second side edges 18A, 18B and a top edge 18C and defines an opening 20 in the enclosure 12, and further including at least one connecting member 24 on the enclosure 12 and being configured to selectively connect and disconnect at least the first side edge 18A and the top edge 18C of the hinged side wall 14A at the opening 20. The method further includes disconnecting the connecting member 24 along the first side edge 18A and the top edge 18C of the hinged side wall 14A, and pivoting the hinged side wall 14A to an open position.

It will be appreciated that the method of hinging a side wall of a portable shelter to an open position in accordance with this disclosure also may include providing a first portion 24A of the connecting member along at least the first side edge 18A or the top edge 18C of the hinged side wall 14A. The method also may include a complementary further step of providing a second portion 24B of the connecting member 24 along a portion of a perimeter edge 22 of the opening 20 of the enclosure 12.

The method of hinging a side wall of a portable shelter to an open position in accordance with this disclosure also may include having the enclosure 12 include a pop up structure having each of the side walls 14, 14A and the top wall 16 further include at least one hub 50 that is connected to a plurality of rods 52, with the plurality of rods 52 being connected to a fabric panel 54. The method may then include, for each of the side walls 14, 14A and the top wall 16 of the enclosure 12, the plurality of rods 52 are pivotally connected to the at least one hub 50 and are movable from a collapsed position to an erected position that places the fabric panel 54 in tension, with the method including the step of pivoting the rods 52 relative to the hubs 50 of the respective top walls 16 and side walls 14, 14A to erect the pop up structure of the enclosure 12. As shown in FIGS. 1-4, it will be understood that, consistent with this disclosure, the enclosure may have a single or multiple fabric panels connected together when providing side walls and one or multiple top walls of an enclosure.

From the above disclosure, it will be apparent that portable shelters with a hinged side wall that are constructed in accordance with this disclosure may include a number of structural aspects that provide numerous advantages over conventional constructions. The example portable shelters shown herein may exhibit one or more of the above-referenced potential advantages, depending upon the specific design chosen.

It will be appreciated that portable shelters constructed in accordance with the present disclosure may be provided in various configurations. Any variety of suitable materials of construction, configurations, shapes and sizes for the components and methods of connecting the components may be utilized to meet the particular needs and requirements of an end user. It will be apparent to those skilled in the art that various modifications can be made in the design and construction of such convertible shelter systems, as well as in the method of assembling a convertible shelter system, without departing from the scope or spirit of the claimed subject matter, and that the claims are not limited to the preferred embodiments and methods illustrated herein. It also will be appreciated that the example embodiments may be shown in simplified form, so as to focus on the key components and to avoid including structures that are not necessary to the disclosure and that would over complicate the drawings.

The invention claimed is:

1. A portable shelter having a hinged side wall, comprising:

an enclosure that includes a plurality of interconnected side walls defining a floor space and being connected to a top wall;

wherein bottoms of the plurality of side walls form a base of the enclosure and the enclosure further comprises an exterior skirt extending outward from the base;

at least one of the side walls further comprising a hinged side wall that is pivotally connected to the enclosure and includes opposed first and second side perimeter edges and a top perimeter edge of the hinged side wall that define an opening in the enclosure, and wherein a portion of the skirt is connected to and extends outward from the hinged side wall;

wherein the top wall and respective side walls that are adjacent the hinged side wall and further define the opening in the enclosure are permanently connected by fabric;

at least one connecting member on the enclosure and being configured to selectively connect and disconnect at least the first side perimeter edge and the top perimeter edge of the hinged side wall at the opening, wherein the hinged side wall with the portion of the skirt connected to the hinged side wall is pivotable about a generally vertical axis to an open position that provides open and unobstructed access to the floor space of the enclosure; and wherein at least one of the side walls further comprises a doorway.

2. The portable shelter in accordance with claim 1, wherein the at least one connecting member further comprises complementary opposed first and second connectors located along at least a portion of the first side perimeter edge and the top perimeter edge of the hinged side wall and along the opening in the enclosure, respectively.

3. The portable shelter in accordance with claim 1, wherein the at least one connecting member extends continuously along the first side perimeter edge and the top perimeter edge of the hinged side wall.

4. The portable shelter in accordance with claim 1, wherein the at least one connecting member further comprises at least a portion of a zipper assembly.

5. The portable shelter in accordance with claim 1, wherein the hinged side wall further comprises at least one anchor strap extending from a bottom edge of the hinged side wall and having an aperture that receives a ground penetrating anchor.

6. The portable shelter in accordance with claim 5, wherein the at least one anchor strap is configured for use in holding the hinged side wall in a hinged open position.

7. The portable shelter in accordance with claim 1, wherein at least one of the side walls further comprises a window.

8. The portable shelter in accordance with claim 1, wherein the enclosure further comprises a hinge limiter that limits the extent to which the hinged side wall is able to be hinged open about the generally vertical axis from the opening in the enclosure.

9. The portable shelter in accordance with claim 1, wherein the enclosure further comprises a pop up structure wherein each side wall and the top wall have at least one hub that is connected to a plurality of rods, with the plurality of rods being connected to a fabric panel.

10. The portable shelter in accordance with claim 9, wherein each hub has the plurality of rods pivotally connected to the hub and the plurality of rods are movable to achieve an erected position that places the fabric panel in tension.

11. The portable shelter in accordance with claim 10, wherein for each of the side walls and the top wall of the enclosure, the plurality of rods that are pivotally connected to the at least one hub and are movable between a collapsed position and the erected position.

12. The portable shelter in accordance with claim 1, wherein at least one of the first side perimeter edge and the top perimeter edge of the hinged side wall further comprises a first portion of the connecting member that is configured to be connected to a second portion of the connecting member located at the opening of the enclosure.

13. The portable shelter in accordance with claim 12, wherein the second portion of the connecting member is located at a portion of a perimeter edge of the opening of the enclosure.

14. The portable shelter in accordance with claim 1, wherein the respective side walls that are adjacent the hinged side wall are wider than the hinged side wall.

15. The portable shelter in accordance with claim 14, wherein each of the respective side walls that are adjacent the hinged side wall further comprises a pop up structure having at least two hubs, with each hub connected to a plurality of rods.

16. The portable shelter in accordance with claim 15, wherein the plurality of rods are connected to a fabric panel.

* * * * *